United States Patent [19]

Stöckel et al.

[11] 4,127,700

[45] Nov. 28, 1978

[54] METALLIC MATERIAL WITH ADDITIVES EMBEDDED THEREIN AND METHOD FOR PRODUCING THE SAME

[75] Inventors: Dieter Stöckel; Friedrich Schneider; Hermann Heiss, all of Pforzheim, Germany

[73] Assignee: G. Rau, Pforzheim, Germany

[21] Appl. No.: 512,320

[22] Filed: Oct. 4, 1974

[30] Foreign Application Priority Data

Oct. 12, 1973 [DE] Fed. Rep. of Germany ..... 2351226

[51] Int. Cl.[2] ..... B22F 1/04

[52] U.S. Cl. ..... 428/558; 75/208 R; 75/232; 75/235; 75/243; 75/234; 428/546; 428/548; 428/552; 428/553; 428/557; 428/565; 428/373

[58] Field of Search ..... 75/DIG. 1, 208 CS, 207; 29/414, 191.2, 191.6, 195, 194, 193, 193.3; 428/373, 397

[56] References Cited

U.S. PATENT DOCUMENTS

| | | | |
|---|---|---|---|
| 2,888,740 | 6/1959 | Danis | 29/191.2 |
| 2,953,849 | 9/1960 | Morgan | 75/DIG. 1 |
| 3,029,496 | 4/1962 | Levi | 75/DIG. 1 |
| 3,254,189 | 5/1966 | Evanicsko et al. | 75/DIG. 1 |
| 3,496,622 | 2/1970 | Berghout et al. | 29/191.6 |
| 3,596,349 | 8/1971 | Boom et al. | 29/419 R |
| 3,683,485 | 8/1972 | Schierding et al. | 29/419 |
| 3,698,863 | 10/1972 | Roberts et al. | 29/191.6 X |
| 3,864,807 | 2/1975 | Schneider et al. | 29/419 R |

*Primary Examiner*—Richard E. Schafer
*Attorney, Agent, or Firm*—Wenderoth, Lind & Ponack

[57] ABSTRACT

A metallic material, particularly useful for electrical contacts, comprises a matrix metal, for example silver or copper, with additives embedded therein in powder form. However, while being in powder form the additives are arranged in elongate fiber like lengths preferably parallel fiber like lengths. A method of producing such a distribution is to fill a tube of the matrix metal with the powder and draw it out to wire thickness, bundle a number of such wires together and fuse the outer coverings to form a continuous matrix with embedded fiber like lengths of powder.

10 Claims, 3 Drawing Figures

METALLIC MATERIAL WITH ADDITIVES EMBEDDED THEREIN AND METHOD FOR PRODUCING THE SAME

BACKGROUND OF THE INVENTION

The invention relates to a metallic material with additives, advantageously non-metallic additives, embedded therein, more particularly a contact material for electric contacts. Advantageous methods for producing such a material are also disclosed.

Silver and its alloys are predominantly used as material for electric contacts because apart from having a very high electric conductivity these contact materials have an adequate resistance to oxidation and favourable properties regarding transfer resistance. Known contact materials based on silver are subject to an undesirable tendency to weld, for the contact surfaces to stick to each other or for material to migrate between contact members, and an excessive burning rate in the case of highly loaded switching contacts which are subject to arcing in the course of the switching operation.

To overcome these disadvantages the contact materials have been improved by additions to the silver or silver alloy parent material. Known additives include metal oxides such as cadmium oxide, stannic oxide, magnesium oxide, zinc oxide, lead oxide and the like which are embedded in finely divided form in the parent material. Contact materials of this kind have a reduced burn-up, reduced welding in switching and a relatively low contact resistance. Oxides are introduced into the silver parent material mainly in accordance with two known methods:

- powder metallurgy in which silver powder and metal oxide powder is compressed and subsequently sintered; and
- internal oxidation in which an alloy of silver is annealed in an oxidizing atmosphere with a baser metal, for example cadmium, zinc or tin. In this latter method the oxygen diffuses into the interior of the alloy and reacts with the baser alloying constituent while forming an oxide distribution in fine dispersion.

Powder metallurgical production of the contact material may be accompanied by irregular mixing of the pulverized constituents. Furthermore, compression and sintering operations may be subject to demixing which in turn results in concentration fluctuations. Materials produced by powder metallurgy also give rise to specific difficulties in chipless forming because they have only a low ductility, particularly if the non-metallic components represent a high proportion.

If the contact materials are produced by the method of internal oxidation the concentration of the metal oxide will be defined by the solubility of the alloying metal in silver and by the appearance of the so-called external oxidation. This phenomonen prevents further ingress of oxygen due to the formation of oxygen-impermeable cohesive oxide films and thus prevents selective oxidation of the baser alloying constituents in the interior of the silver parent material. For example, it is not possible to subject alloys containing more than 2% by weight of tin to internal oxidation. The kinetics of internal oxidation moreover give rise to a particle size gradient of the oxide extending from the surface into the interior of the material. As a consequence it is not possible to maintain the required uniformity of oxide particle size.

SUMMARY OF THE INVENTION

The present invention seeks to provide an improved alloy and method of production.

According to one aspect of the invention there is provided a metallic material comprising a matrix metal with additive material embedded therein, the additive material being in powder form and being arranged in elongated fiber or lengths.

The characterizing feature of the invention is that at least one pulverized constituent is embedded in fiber form in the metallic parent material. The proportion of embedded additives and the distribution thereof can be defined practically at random in such a material. A metallic material of this kind is suitable not only as contact material but also appears to be suitable as electrode material or for the mechanical reinforcement of specific metallic parent (matrix) metals in the construction of components in reactor technology and superconductors. Metallic materials with embedded fibres are known in the prior art, but hitherto it was evidently not known to embed fibers or fiber-like lengths of pulverized material instead of continuous, homogeneous fibres into a metallic material.

Fiber-like lengths of oxides such as CdO, $SnO_2$, $Al_2O_3$, MgO, CaO, $ZrO_2$, PbO and mixtures of such oxides can be advantageously embedded in the matrix. The embedding of intermetallic compounds such as NbTi, in fiber form is another possibility. High melting metals in pulverized form, for example tungsten or molybdenum, can also be embedded in fiber form in the metallic parent material. Further advantageous metal compounds capable of being embedded include carbides, nitrites, borides and the like, also graphite, glass and organic powder. Silver and copper or alloys consisting predominantly of these substances are suitable as the matrix metal. It can also be advantageous if the powder materials embedded in the matrix are substantially uniformly distributed. An advantageous uniform distribution can be obtained if the powder fibers or lengths are situated substantially parallel to each other. Advantageously, the thickness of the individual embedded cords should be of the order of microns, preferably less than ten microns.

According to another aspect of the invention there is provided a method making a metallic material comprising the steps of providing a pipe of matrix metal, filling the pipe with an additive in powder form, forming the filled pipe in a first forming operation to wire of narrower diameter comprising a sheath of matrix metal filled with the powdered additive, bundling a number of such wires together and forming the bundle in a second forming operation to a unit of narrower diameter in which the sheaths of matrix metal are combined to give a uniform matrix, the additive material being embedded therein in powder form and being distributed in fiber form.

The wires can be combined with like supplementary substances as well as with unlike supplementary substances or those having a different core cross-section. Powder can be filled in by different methods, where appropriate under vacuum or by the action of ultrasonics. The use of pre-compressed powder slugs can also be advantageous.

It can also be advantageous to perform intermediate annealing operations between the deformation operations in the chipless deformation of pipes to form the sheathing wires and/or in the chipless deformation of the sheathing wires thus formed.

Where appropriate a further advantage can be achieved if the sheathing wires are bundled in a tubular member of matrix material and are chiplessly deformed together therewith. Such a tubular member can be produced in different angular, circular or elliptical cross-sectional shapes. The tubular member can be retained as part of the matrix after the desired fiber cross-section has been obtained.

It appears to be advantageous for different applications to remove the tubular member by chemical and/or chipforming processes or by electrolytic processes after the desired fiber cross-section has been obtained. An easily detachable material can be advantageously employed for the tubular member.

An important improvement can be obtained in some circumstances if the finished shaped member produced by chipless forming and containing the pulverized proportions in fiber form is subsequently subjected to heat treatment in which the individual powder grains of the core material are sintered together to form continuous fibres.

According to the features of the invention it is thus possible to produce metallic materials with embedded and preferably non-metallic additives, more particularly contact materials for electric contacts which can be highly loaded, such materials combining favourable physical properties with the advantages of the manufacturing method.

There follows an example of one method embodying the invention:

Cadmium oxide powder with a particle size of less than 1 was filled into a tube of high purity silver of 13 mm external diameter which was closed at one end and had a wall thickness of 3 mm. The powder was consolidated by mechanical vibration at a frequency of approximately 50 Hz and the additional application of pressure by means of a tappet which was clamped into a hydraulic press.

After filling, the pipe end which was still open was closed by welding. The pipe was then chiplessly deformed by hammering to a diameter of 8 mm. This was followed by various drawing operations each giving a cross-sectional reduction of 20%. Intermediate anneals were performed at a temperature of approximately 300° C. When the pipe was reduced to a wire of a diameter of approximately 0.3 mm a number of the wires were bundled and inserted into a silver tube with an external diameter of approximately 20 mm and a wall thickness of 0.5 mm. This tube was then deformed by drawing so that the diameter of the embedded, pulverized core fiber-like lengths was each approximately 5$\mu$. The external diameter of the finished unit in this state was approximately 2 mm. The weight percentage of the embedded cadmium oxide in the finished unit was approximately 10%.

BRIEF DESCRIPTION OF THE DRAWING

One embodiment of the invention is diagrammatically illustrated in the accompanying drawings in which.

DETAILED DESCRIPTION OF THE INVENTION

Figure 1:
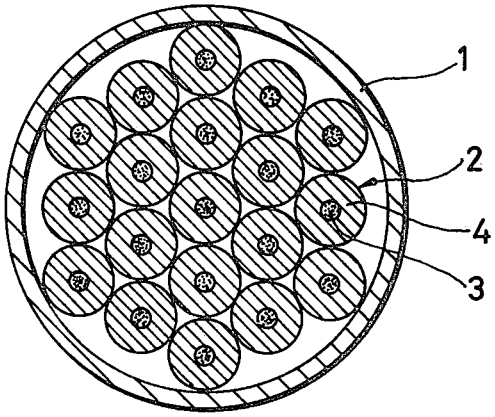
FIG. 1 is a cross-sectional view of a unit of metallic material during the coarse of manufacture.

Referring to the drawings, FIG. 1 shows a tubular member 1 of matrix metal with metal wires 2 embedded therein, each of the metal wires 2 comprising a powder core 3 and a sheath 4 of the same matrix metal.

Figure 2:
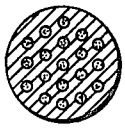
FIG. 2 is a cross-sectional view of the completed unit after forming operations have been performed on the unit of FIG. 1.

FIG. 2 shows the cross-sectional shape of a compound unit formed by chipless forming and drawing of the structure of FIG. 1.

Figure 3:
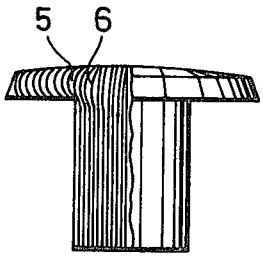
FIG. 3 is a cross-section through a contact rivet made from the unit of FIG. 2.

The enlarged sectional view of FIG. 3 shows a contact rivet formed from the unit of FIG. 2. The diameter of the rivet head is approximately 4 mm, the shank diameter being 2 mm. The contact rivet intended for use as highly stressed switch contacts has a height of 8 mm. In this embodiment the matrix metal 5 is silver and the embedded powder fibres 6 are of cadmium oxide.

We claim:

1. An elongate metallic material comprising a matrix metal with additive material embedded therein, said additive material being in powder form, said powder being distributed about a plurality of fiber-like lengths extending along the length of the material. --.

2. Metallic material as claimed in claim 1 wherein the additive material comprises at least one oxide.

3. Metallic material as claimed in claim 1 wherein the additive material comprises at least one intermetallic compound.

4. Metallic material as claimed in claim 1 wherein the additive material comprises at least one other metal.

5. Metallic material as claimed in claim 1 wherein the additive material comprises graphite.

6. Metallic material as claimed in claim 1 wherein the additive material is distributed in uniformly distributed fiber-like lengths.

7. Metallic material as claimed in claim 1 wherein the additive material is distributed in parallel fiber-like lengths.

8. Metallic material as claimed in claim 1 wherein the thickness of the additive fiber-like lengths is of the order of microns.

9. Metallic material as claimed in claim 1 wherein at least the predominant proportion of the matrix metal consists of high purity silver.

10. Metallic material as claimed in claim 1 wherein at least the predominant proportion of the matrix metal consists of copper.

* * * * *